United States Patent [19]

Rautsola et al.

[11] Patent Number: 5,000,349

[45] Date of Patent: Mar. 19, 1991

[54] ASEPTIC PACKAGE TAP

[76] Inventors: Riku H. Rautsola, Gerhart-Hauptmann-Str. 4, 6370 Oberursel; Victor Krutten, Hermann-Schuster-Str. 66, 6274 Hünstetten 4, both of Fed. Rep. of Germany

[21] Appl. No.: 463,907

[22] Filed: Jan. 10, 1990

Related U.S. Application Data

[63] Continuation of Ser. No. 194,963, May 17, 1988, abandoned.

[51] Int. Cl.[5] ..... B67D 5/00

[52] U.S. Cl. ..... 222/90; 222/83; 222/464; 222/542; 222/569; 285/196; 403/193; 403/239; 403/243

[58] Field of Search ..... 222/464, 542; 403/193, 403/194, 197, 238, 239, 243; 277/113, 102; 285/162, 196, 338

[56] References Cited

U.S. PATENT DOCUMENTS

| | | | |
|---|---|---|---|
| 850,410 | 4/1907 | Weatherhead | 285/196 |
| 966,413 | 8/1910 | Alkire | 222/569 |
| 966,748 | 8/1910 | Honecker | 403/193 X |
| 1,992,319 | 2/1935 | Maggenti . | |
| 1,992,320 | 2/1935 | Maggenti . | |
| 1,998,586 | 4/1935 | Maggenti . | |
| 2,690,279 | 9/1954 | Ward | 222/547 X |
| 2,756,078 | 7/1956 | Klinger | 285/196 X |
| 2,779,517 | 1/1957 | Beall, Jr. | 222/542 X |
| 3,149,762 | 9/1964 | Decker | 222/567 X |
| 3,235,133 | 2/1966 | Zimmerman et al. | 222/568 X |
| 3,305,135 | 2/1967 | Lemoine | 222/90 |
| 3,822,700 | 7/1974 | Pennington | 222/81 X |
| 3,879,065 | 4/1975 | Kobayashi | 285/162 X |
| 4,724,981 | 2/1988 | Realmato | 222/90 |
| 4,750,643 | 6/1988 | Wortrich | 222/81 |

FOREIGN PATENT DOCUMENTS

| | | | |
|---|---|---|---|
| 437038 | 11/1926 | Fed. Rep. of Germany | 222/89 |
| 900158 | 11/1953 | Fed. Rep. of Germany | 285/196 |
| 2353010 | 4/1975 | Fed. Rep. of Germany | 222/90 |
| 3531644 | 5/1987 | Fed. Rep. of Germany . | |
| 1316658 | of 0000 | France | 222/81 |
| 857465 | 9/1940 | France | 222/90 |
| 9285 | of 1897 | United Kingdom | 222/567 |
| 428722 | 6/1935 | United Kingdom . | |
| 433679 | 9/1935 | United Kingdom . | |

*Primary Examiner*—Andres Kashnikow
*Assistant Examiner*—Gregory L. Huson
*Attorney, Agent, or Firm*—Beaton & Swanson

[57] ABSTRACT

A tap for aseptic packages of the type which contain solutions and, in particular, solutions for medical applications. The type has a body, a packaging penetrating tip extending from the body, a liquid passageway extending from the tip and through the body for dispensing liquid from the package and a fluid passageway extending from the tip and through the body for admitting make-up air to the package interior. A cylindrical member of resilient material is positioned between the tap body and its penetrating tip and is insertable through the package wall in trailing relation to the tip. The resilient member is selectively compressed along its cylindrical axis to expand within the package and engage the wall to seal the orifice formed by the tip on penetration of the package wall and to secure the tap to the package.

14 Claims, 1 Drawing Sheet

ASEPTIC PACKAGE TAP

This application is a Continuation of application Ser. No. 07/194,963, filed May 17, 1988 (now abandoned).

BACKGROUND OF THE INVENTION

1. Field of the Invention

The present invention relates to a system for the delivery of a solution from an aseptic package and, in particular, to a tap for such a package containing solutions for medical applications such as enteral feeding, as by nasal gauge.

2. Description of the Prior Art.

For the purposes of the present specification and claims, the term "aseptic packaging" is intended to embrace the packaging of various liquids within a carton, the carton being of the type that is punctured to obtain access to the packaged liquid. When the packaged liquid is a food product, such as juices or milk products, it is common practice to puncture the packaging at a preselected location (which is often weakened) and to withdraw the liquid through a straw. In Europe, it is known to provide a "tap" which is pointed to puncture a sidewall of the packaging and which has a fluid passage allowing the contained liquid to be poured through the tap.

The characteristics of the noted aseptic packaging systems render their use desirable in many medical applications. For example, it is often desirable, or necessary, to deliver liquids to a person by a nasal tube for such purposes as enteral feeding, the delivery of nutrients, the delivery of medication, etc. Aseptic packaging is often suitable for such liquids. However, while aseptic packaging has been employed for certain medical solutions, it has often been the practice to open the packages and empty their contents into a more traditional container for delivery. In part, this has resulted from limitations on package size. However, more recent packaging techniques allow the packaging of liquid in greater quantities. Also, the tap described above in the context of food products, has the drawback of not discharging the liquid in an even flow but, instead, discharges the contents of the package intermittedly as air enters the container through the tap.

A tap which addresses the intermittent flow characteristics of the food product taps described above as disclosed in co-pending application Ser. No. 109,230, filed Oct. 16, 1987, in the name of Riku H.. Rautsola for ENTERAL NUTRIENT DELIVERY SYSTEM now U.S. Pat. No. 4,826,500. The Rautsola tap provides, inter alia, a fitting having a projecting/penetrating tip to form an orifice through the carton/package sidewall. A liquid passage through the fitting allows a dispensing of the packaged solution, while provision is made for make-up air to the interior of the package. The fitting is maintained and positioned in the package sidewall by threads which cooperate with the orifice through the package sidewall.

The Rautsola tap is dependent upon the cooperation of the threads of the tap with the package sidewall and also requires a significant relative rotation between the package and fitting for securement and sealing.

SUMMARY OF THE INVENTION

As with the Rautsola delivery system described above (the identified patent of which is hereby incorporated by reference) the present invention provides a system for the enteral delivery of a solution contained within an aseptic package without the intervening step of emptying the package into a traditional container. In this manner, the solution may be dispensed through a giving set and metering system of known design and, typically, via a tube as by nasal gauge. To this end, and in common with the Rautsola tap of the incorporated specification, there is provided a tap having a body, a package pentrating tip extending from the body, a liquid passageway extending from the tip and through the body for dispensing liquid from the package and a fluid passageway extending from the tip through the body for admitting make-up air to the package. The package wall is also engaged to secure the tap within the package wall. However, the tap of the present invention employs a cylindrical member of a resilient material positioned between the body and the penetrating tip, the cylindrical member being insertable through the package wall in trailing relation to the tip. The resilient cylindrical member is selectively compressed, along its cylindrical axis, causing it to expand within the package against the package wall. In this manner, the package wall is engaged without the requirement of a thread-type cooperation between the tap and package wall and without a signifcant relative rotation between the tap and package. In a preferred embodiment of the present invention, a rotation of approximately 90° (one quarter turn) of a portion of the tap of the present invention is required for full engagement of the package wall.

In the disclosed embodiment, the present invention employs a circular platform, the platform having cams extending from its surface toward the package penetrating tip of the tap. A cap having a platen defining an endwall thereof is positioned with the platen generally parallel to the platform and with a sidewall of the cap surrounding a portion of the body. A resilient, cylindrical member is positioned between the cap and pentrating tip for selective compression along its cylindrical axis (and expansion within the package against the package wall) on movement of the cap away from the platform.

The platform of the disclosed preferred embodiment is provided with a plurality of cams while the platen carries multiple cam followers, each cooperating with a different one of the platform cams. On rotation of one or both of the platform and cap relative to the other, the cams and cam followers selectively establish the distance between the cap platen and platform and, accordingly, the state of compression of the resilient member. That is, the relative angular or rotational orientation of the platen and platform establishes the distance between the platen and platform and the state of compression of the cylindrical, resilient member. The cam followers may be formed as ramps with each ramp being provided with a plateau to provide a stable, compressed state of the cylindrical, resilient member.

DETAILED DESCRIPTION OF THE PREFERRED EMBODIMENTS

Figure 1:
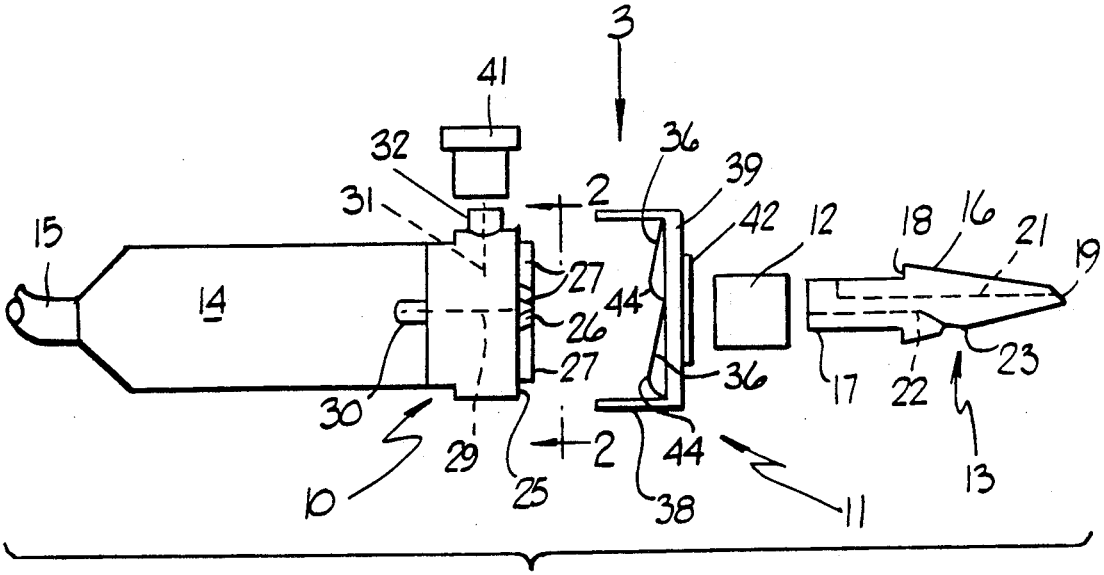
FIG. 1 is an exploded view and partial cut-away illustrating a preferred embodiment of the present invention.

FIG. 1 is an exploded view of a tap in accordance with the present invention, including a body designated generally at 10, a cap designated generally at 11, a cylindrical, resilient member 12 and a penetrating tip member designated generally at 13. The body 10 is secured to a reservoir 14 in any desired manner, the reservoir being connected to an elongated tubing 15 which extends to a "giving set" and any desired metering system. The reservoir 14 may be secured to the body 10 as by gluing it to a collar thereof. Accumulation of solution dispensed from an aseptic package will occur within the reservoir 14, allowing a monitoring of the dispensing.

The penetrating tip 13 includes a generally conical portion 16 and an extending stem 17, the conical portion 16 and stem 17 being joined to each other at a shoulder 18. The conical portion 16 is obliquely truncuated at a surface 19, the surface 19, in cooperation with the conical portion 16, providing a cutting edge to facilitate penetration of an aseptic package. A fluid passageway for make-up air is represented by dashed line 21 and extends from the surface 19 through the tip 13 to exit through the sidewall of the stem 17. A second passageway for solution to be dispensed is represented by a dashed line 22 and extends from an opening 23 in the conical portion 16 of tip 13 and through the stem portion 17. Passageways 21 and 22 cooperate with passageways within the body portion 10 in a matter to be described more fully below.

A generally cylindrical, resilient member 12 is configured to fit over the stem portion 17 of tip 13 to abut against the shoulder 18. On insertion of the tip 13 through the wall of a package, the orifice made by the tip 13 will allow the member 12 to extend through the package wall and into the interior of the package. As will be apparent from the discussion below, the cylindrical, resilient member 12 will be compressed along its cylindrical axis such that it will expand within the packaging to engage the package wall and seal the orifice in that wall formed by the tip 13 as well as secure the tap to the package. The solution within the package will be dispensed through the passageway 22, entering the tip 13 at the opening 23, while make-up air to the interior of the package will enter the package via the passageway 21.

Figure 2:
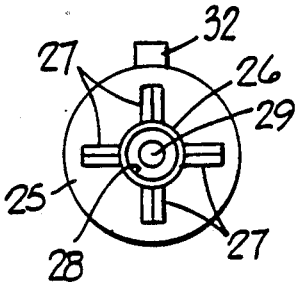
FIG. 2 is a view of the emobidment of FIG. 1 as seen along the line 2—2 of FIG. 1.

The body 10 is provided with a platform 25, the platform 25 having a central hub 26 and extending cam members 27. The hub 26 has a central opening 28 (See FIG. 2) for accepting the stem 17 of tip 13. The stem 17 may be secured within the opening 28 of hub 26 in any desired manner, as by gluing, for example. A first passageway 29 extends from the opening 28 through the body 10 and into the reservoir 14 via a stub 30. The passageway 29 is represented by a dashed line in FIG. 1. A second fluid passageway 31 extends through a stub 32 in a sidewall of the body 10 and is also represented by a dashed line.

The passageway 31 will, on proper orientation of stem 17 within body 10, establish fluid communication with the passageway 21 of tip 13 when the stem 17 of the tip 13 is within the opening 28 of hub 26. Similarily, fluid communication between the passageway 29 of body 10 and the passageway 22 of tip 13 is established when the stem 17 is inserted within the opening 28 and hub 26 of body 10. Thus, a passageway for solution is established through the opening 23, passageway 22 and passageway 29 and into the reservoir 14 for a solution to be dispensed while make-up air for the package interior is provided through the passageway 31 of body 10 and passageway 21 of tip 13.

As described to this point, assembly of the tip 13 and body 10, with their respective passageways 21/31 and 22/29 in communication, establishes a tap by which solution within an aseptic package may be dispensed, with a provision for make-up air. However, the tap, as described to this point, is not securable to a package.

Figure 3:
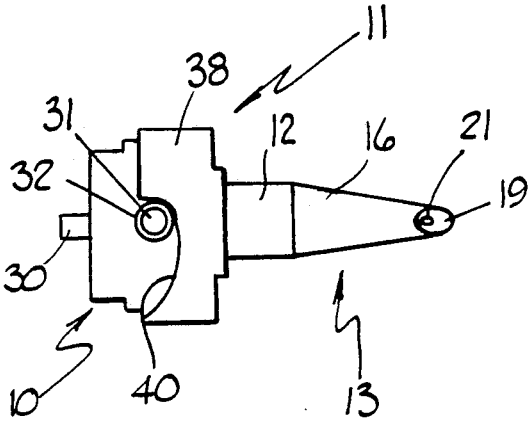
FIG. 3 illustrates a portion of the embodiment of FIG. 1 viewed along the arrow 3 in FIG. 1.
Figure 4:
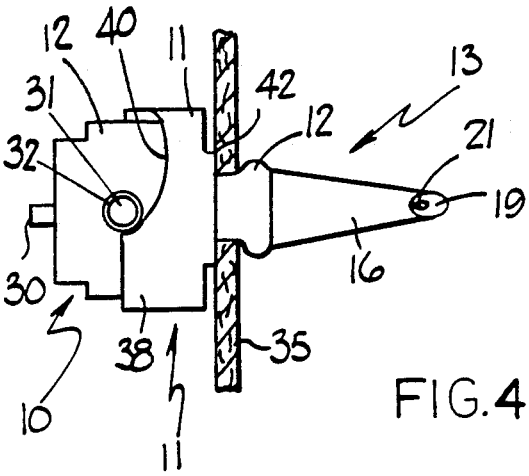
FIG. 4 shows the cooperation of a tap in accordance with FIGS. 1–3 with the wall of a package and is illustrated as viewed in the direction of the arrow 3 in FIG. 1.

Securement of the tap to a package is accomplished by compression of the cylindrical resilient member 12 within the package. As noted above, the member 12 is positioned over the stem 17 and enters the package by an orifice formed by the tip 13. During entry, the member 12 is in its generally cylindrical configuration. This configuration is illustrated in FIG. 3 which may be termed the package penetrating configuration. After entry into the package, the member 12 is compressed along its cylindrical axis to expand within the package and engage the sidewall of the package to seal the orifice formed by the tip 13 and also to secure the tap to the package. This configuration of the member 12 is illustrated in FIG. 4 with the cut-away element 35 representing the package wall.

Compression of the member 12 is accomplished by a camming cooperation between the cams 26 on the platform 25 and cam surfaces 36 within a cap 38. The cap 38 includes an endwall 39, the inner surface of which serves as a platen carrying the camming surfaces 36. In a preferred embodiment, the platform 25 is generally circular, while the sidewall of the cap 38 is cylindrical and extends over the body 10 with the platen surface of endwall 38 being generally parallel to the platform 25. The cam surfaces 36 each cooperate with a different one of the cams 27 and are formed as ramps such that the relative rotation or orientation of the cap 38 and body member 10 establishes the distance between the platen surface of endwall 39 and the platform 25. That is, rotation of the cap 38, for example, relative to the platform 25 causes the cams 27 to ride up the platforms of camming surfaces 36 and urge the cap away from the platform 25 and into compressing relation with the member 12. Compression of the member 12 along its cylindrical axis will result in an enlargement of that member in a radial direction, causing it to engage a wall 35 within a package it has penetrated--see FIG. 4. In this manner, the tap is secured to the package wall while the orifice through that wall is sealed.

Obviously, many modifications and variations of the present invention are possible in light of the above teachings. For example, the sidewall of the cap 38 facilitates manipulation of that cap during relative rotational movement with the body 10, and its platform 25. To facilitate that movement, while maintaining compactness in the tap, it may desirable to provide the sidewall with a cutout to accommodate the stub 32. This cutout is illustrated at 40 in FIGS. 3 and 4. Also, to control the inlet for make-up air, it may be desirable to provide a cap for the stub 32. Such a cap is illustrated at 41 in FIG. 1. The cap 41 will also assist in manipulation of the body 10 during establishment of its relative angular orientation with the cap 38. The cap 41 is not illustrated in FIGS. 2–4. Further, to reduce friction between the wall 35 and a penetrated package (during rotation of the cap 38, for example), it may be desirable to provide a reduced surface engagement area on the cap 38 such as that illustrated at 42. The surface 42 may be provided with a recess to accept the end of the member 12, as desired. Finally, to provide a compressed state of member 12 having enhanced stability, the camming surfaces 36 may be provided with plateaus in the regions indicated at 44, the plateaus being either ramps of reduced angle or "flat" portions. It is therefore to be understood that, within the scope of the appended claims, the invention may be practiced otherwise than is specifically described.

What is claimed is:

1. A tap for aseptic carton packages, said tap comprising:

a body;

a package penetrating tip extending from the body to penetrate the package to produce a hole in the package, including a generally conical portion and an extending stem joined to each other at a shoulder;

a liquid passageway extending from the tip and through the body for dispensing the liquid from the package;

a fluid passageway extending from the tip and through the body for admitting make-up air to the package;

cylindrical means for engaging the package wall, said cylindrical means being of a resilient material and being configured to fit over the stem to extend within the package through the package penetration hole, and said cylindrical means having a first diameter within the package; and means for expanding a portion of the cylindrical means within the package to a second diameter, wherein the second diameter is greater than the first diameter and greater than the package penetration hole diameter in order to anchor the tip within the package.

2. The aseptic package tap of claim 1 wherein said body comprises a platform, and said package engaging means further comprising:

platen positioned between said platform and cylindrical, resilient means, said platen and platform being generally parallel and rotatable relative to each other; and cam means and cam follower means carried by said platen and platform in cooperating relation to each other, the distance between said platen and platform being selectively established by the relative rotational orientation of said platen and platform wherein said cylindrical resilient means urges said platen and platform toward each other.

3. The aseptic package tap of claim 2 wherein said cam means comprise multiple cams extending from said platform toward said platen, and said cam followers comprise multiple ramps carried by said platen each cooperating with a different one of said cams.

4. The aseptic package tap of claim 3 wherein said cam followers further comprise a plateau region wherein said cylindrical, resilient means is maintained in a stable, compressed state.

5. The aseptic package tap of claim 2 wherein said platform is generally circular, said platen defining the end wall of a cap and the cap having a sidewall extending over a portion of said body.

6. The aseptic package tap of claim 5 wherein said cam means comprise multiple cams extending from said platform toward said platen, said cam followers comprising multiple ramps carried by said platen each cooperating with a different one of said cams.

7. The aseptic package tap of claim 6 wherein said cam followers further comprise a plateau region wherein said cylindrical, resilient means is maintained in a stable, compressed state.

8. A tap for aseptic carton packages, said tap comprising:

a body;

a package penetrating tip extending from the body to penetrate the package to produce a hole in the package, including a generally conical portion and an extending stem joined to each other at a shoulder;

a liquid passageway extending from the tip and through the body for dispensing liquid from the package;

a fluid passageway extending from the tip and through the body for admitting make-up air to the package;

cylindrical means for engaging the package wall, said cylindrical means being of a resilient material and being configured to fit over the stem to extend within the package through the package penetration hole and to abut said shoulder between said body and said tip; and means for urging the exterior cylindrical surface of said cylindrical means against said wall within the package penetration hole in order to anchor the tip within the package.

9. The aseptic package tap of claim 8 wherein said body comprises a platform, and said package engaging means further comprising:

platen positioned between said platform and cylindrical, resilient means, said platen and platform being generally parallel and rotatable relative to each other; and cam means and cam follower means carried by said platen and platform in cooperating relation to each other, the distance between said platen and platform being selectively established by the relative rotational orientation of said platen and platform wherein said cylindrical resilient means urges said platen and platform toward each other.

10. The aseptic package tap of claim 9 wherein said cam means comprise multiple cams extending from said platform toward said platen, and said cam followers comprise multiple ramps carried by said platen each cooperating with a different one of said cams.

11. The aseptic package tap of claim 10 wherein said cam followers further comprise a plateau region wherein said cylindrical, resilient means is maintained in a stable, compressed state.

12. The aseptic package tap of claim 9 wherein said platform is generally circular, said platen defining the end wall of a cap and the cap having a sidewall extending over a portion of said body.

13. The aseptic package tap of claim 12 wherein said cam means comprise multiple cams extending from said platform toward said platen, said cam followers comprising multiple ramps carried by said platen each cooperating with a different one of said cams.

14. The aseptic package tap of claim 13 wherein said cam followers further comprise a plateau region wherein said cylindrical, resilient means is maintained in a stable, compressed state.

* * * * *